US009374639B2

(12) United States Patent
Hayashi

(10) Patent No.: US 9,374,639 B2
(45) Date of Patent: Jun. 21, 2016

(54) AUDIO APPARATUS AND METHOD OF CHANGING SOUND EMISSION MODE

(71) Applicant: YAMAHA CORPORATION, Hamamatsu-shi, Shizuoka (JP)

(72) Inventor: Toyofumi Hayashi, Hamamatsu (JP)

(73) Assignee: Yamaha Corporation, Hamamatsu-shi (JP)

( * ) Notice: Subject to any disclaimer, the term of this patent is extended or adjusted under 35 U.S.C. 154(b) by 336 days.

(21) Appl. No.: 13/713,502

(22) Filed: Dec. 13, 2012

(65) Prior Publication Data

US 2013/0156236 A1 Jun. 20, 2013

(30) Foreign Application Priority Data

Dec. 15, 2011 (JP) ..... 2011-274250

(51) Int. Cl.

| | |
|---|---|
| ***H04R 3/12*** | (2006.01) |
| ***H04R 5/04*** | (2006.01) |
| *H04R 1/02* | (2006.01) |
| *H04R 5/02* | (2006.01) |
| *H04R 1/40* | (2006.01) |

(52) U.S. Cl.

CPC .. *H04R 3/12* (2013.01); *H04R 1/02* (2013.01); *H04R 5/04* (2013.01); *H04R 1/025* (2013.01); *H04R 1/028* (2013.01); *H04R 1/403* (2013.01); *H04R 5/02* (2013.01); *H04R 2201/025* (2013.01); *H04R 2205/021* (2013.01)

(58) Field of Classification Search

None

See application file for complete search history.

(56) References Cited

U.S. PATENT DOCUMENTS

| | | | | |
|---|---|---|---|---|
| 8,879,761 | B2 * | 11/2014 | Johnson et al. | 381/306 |
| 2003/0156075 | A1 | 8/2003 | Motoyama et al. | |
| 2007/0201705 | A1 | 8/2007 | Dorogusker et al. | |
| 2011/0002487 | A1 * | 1/2011 | Panther et al. | 381/300 |
| 2011/0235808 | A1 | 9/2011 | Kon | |
| 2011/0316768 | A1 * | 12/2011 | McRae | 345/156 |
| 2012/0070017 | A1 | 3/2012 | Dorogusker et al. | |

FOREIGN PATENT DOCUMENTS

| | | | |
|---|---|---|---|
| JP | 2000-267641 | A | 9/2000 |
| JP | 2003-244786 | A | 8/2003 |
| JP | 2006-94367 | A | 4/2006 |
| JP | 2008-85803 | A | 4/2008 |
| JP | 2009-528576 | A | 8/2009 |
| JP | 2011-211296 | A | 10/2011 |

OTHER PUBLICATIONS

Japanese Office Action dated Dec. 3, 2013 w/ English translation (six (6) pages).

* cited by examiner

*Primary Examiner* — Andrew L Sniezek

(74) *Attorney, Agent, or Firm* — Crowell & Moring LLP

(57) ABSTRACT

An audio apparatus includes a main body, a plurality of speakers provided in the main body, a storage section configured to store a conversion table which indicates a correspondence between postures of the main body and control contents of audio signals to be supplied to the speakers, and a control section configured to refer to the conversion table of the storage section, and control the audio signals to be supplied to the speakers in accordance with a posture of the main body.

11 Claims, 10 Drawing Sheets

FIG.9

| DETECTION RESULT | SPEAKER15A | SPEAKER 15B | SPEAKER 15C | SPEAKER15D |
|---|---|---|---|---|
| LOWER SURFACE IS DOWNWARD DIRECTED | L High | R High | L Low | R Low |
| LEFT SURFACE IS DOWNWARD DIRECTED | L Low | L High | R Low | R High |
| UPPER SURFACE IS DOWNWARD DIRECTED | R Low | L Low | R High | L High |
| RIGHT SURFACE IS DOWNWARD DIRECTED | R High | R Low | L High | L Low |
| BACK SURFACE IS DOWNWARD DIRECTED | R | L | L | R |
| FRONT SURFACE IS DOWNWARD DIRECTED | Mute | Mute | Mute | Mute |

FIG.10

| POSTURE INFORMATION OF EXTERNAL DEVICE | POSTURE OF AUDIO APPARATUS 1 | SPEAKER 15A | SPEAKER 15B | SPEAKER 15C | SPEAKER 15D |
|---|---|---|---|---|---|
| FRONT SURFACE IS DOWNWARD DIRECTED | LOWER SURFACE IS DOWNWARD DIRECTED | L High | R High | L Low | R Low |
| LEFT SURFACE IS DOWNWARD DIRECTED | LEFT SURFACE IS DOWNWARD DIRECTED | L Low | L High | R Low | R High |
| BACK SURFACE IS DOWNWARD DIRECTED | UPPER SURFACE IS DOWNWARD DIRECTED | R Low | L Low | R High | L High |
| RIGHT SURFACE IS DOWNWARD DIRECTED | RIGHT SURFACE IS DOWNWARD DIRECTED | R High | R Low | L High | L Low |
| LOWER SURFACE IS DOWNWARD DIRECTED | BACK SURFACE IS DOWNWARD DIRECTED | R | L | L | R |
| UPPER SURFACE IS DOWNWARD DIRECTED | FRONT SURFACE IS DOWNWARD DIRECTED | Mute | Mute | Mute | Mute |

AUDIO APPARATUS AND METHOD OF CHANGING SOUND EMISSION MODE

BACKGROUND

The present invention relates to an audio apparatus which realizes various sound emission modes and a method of changing sound emission modes of the audio apparatus.

Conventionally, as an audio apparatus which performs various processes in accordance with the installation posture, for example, JP-A-2000-267641 proposes an audio apparatus in which the display mode of a display device is switched to the vertical display mode or the horizontal display mode depending on a vertical installation or a horizontal installation of the audio apparatus.

In the audio apparatus of JP-A-2000-267641, even when the installation posture is changed, however, sounds output from speakers of the audio apparatus remain unchanged.

Therefore, it is an object of the invention to provide an audio apparatus which realizes various sound emission modes in accordance with the installation posture thereof and a method of changing the sound emission modes of the audio apparatus.

SUMMARY

In order to achieve the above object, according to the present invention, there is provided an audio apparatus comprising:

a main body;

a plurality of speakers provided in the main body;

a storage section configured to store a conversion table which indicates a correspondence between postures of the main body and control contents of audio signals to be supplied to the speakers; and a control section configured to refer to the conversion table of the storage section, and control the audio signals to be supplied to the speakers in accordance with a posture of the main body.

For example, the audio apparatus further comprising:

a receiving section which receives posture information from an external device, wherein the control section configured to detect the posture of the main body based on the posture information received by the receiving section.

For example, the audio apparatus further comprising:

a supply destination information receiving section that receives supply destination information indicative of supply destinations of the audio signals, from an external device, wherein the control section configured to determine the speakers of the supply destinations of the audio signals, based on the supply destination information received by the supply destination information receiving section.

For example, the control section configured to control channels of the audio signals to be supplied to the speakers.

For example, the control section configured to control bands of the audio signals to be supplied to the speakers.

For example, the audio apparatus further comprising:

a receiving section which receives content data from an external device, wherein the control section configured to supply the audio signals to the speakers to reproduce the content data.

For example, the audio apparatus further comprising:

a connector provided on the housing, wherein the connector is configured that an external device is attached thereto in the same posture as that of the main body.

According to the present invention, there is also provided a method of changing a sound emission mode of an audio apparatus, comprising:

receiving posture information;

referring to a conversion table stored in a storage section, wherein the conversion table indicates a correspondence between postures of a main body of the audio apparatus and control contents of audio signals to be supplied to speakers provided in the main body; and controlling the audio signals to be supplied to the speakers in accordance with a posture of the main body and the correspondence of the conversion table.

For example, the method further comprising:

receiving posture information from an external device; and detecting the posture of the main body based on the posture information received from the external device.

For example, the method further comprising:

receiving supply destination information indicative of supply destinations of the audio signals, from an external device, determining the speakers of the supply destinations of the audio signals, based on the supply destination information received from the external device.

For example, in the controlling process, channels of the audio signals to be supplied to the speakers are controlled.

For example, in the controlling process, bands of the audio signals to be supplied to the speakers are controlled.

For example, the method further comprising:

receiving content data from an external device; and supplying the audio signals to the speakers to reproduce the content data.

According to the invention, it is possible to realize various sound emission modes in accordance with the installation posture.

BRIEF DESCRIPTION OF THE DRAWINGS

The above objects and advantages of the present invention will become more apparent by describing in detail preferred exemplary embodiments thereof with reference to the accompanying drawings, wherein:

FIG. 9 is a view showing a conversion table in which the posture of the apparatus is corresponded to control contents regarding audio signals to be supplied to speakers.

FIG. 10 is a view showing a modification of the conversion table.

DETAILED DESCRIPTION OF EXEMPLARY EMBODIMENTS

Hereinafter, an embodiment of the audio apparatus of the invention will be described with reference to the drawings.

Figure 1A:
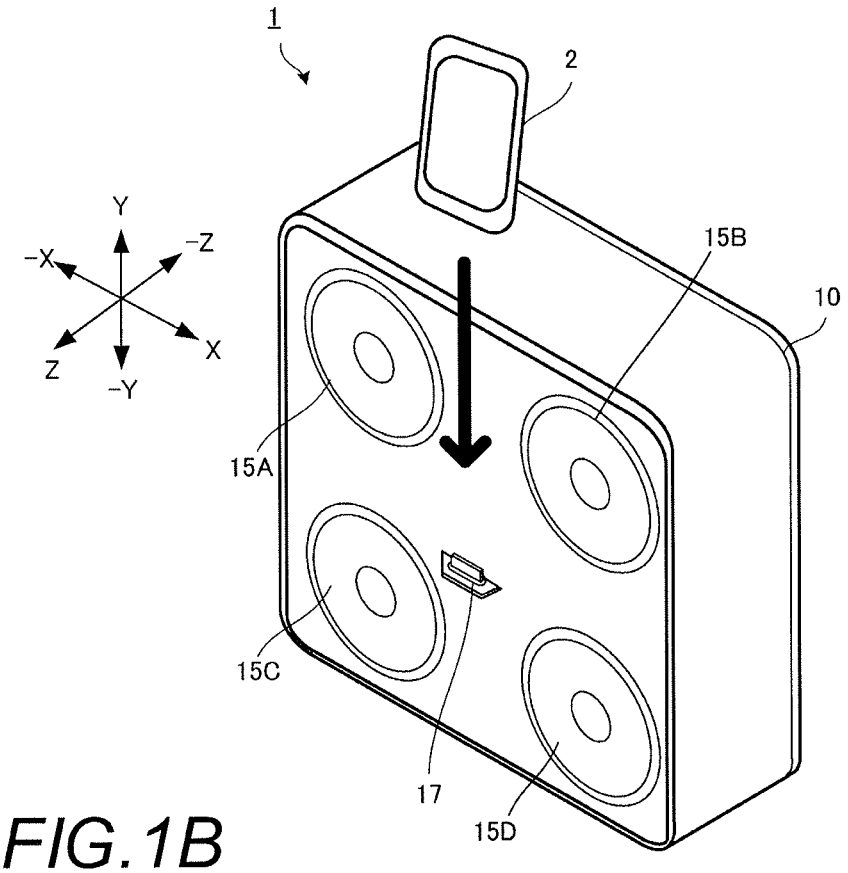
FIG. 1A is an external perspective view of an audio apparatus and an external device.
Figure 1B:
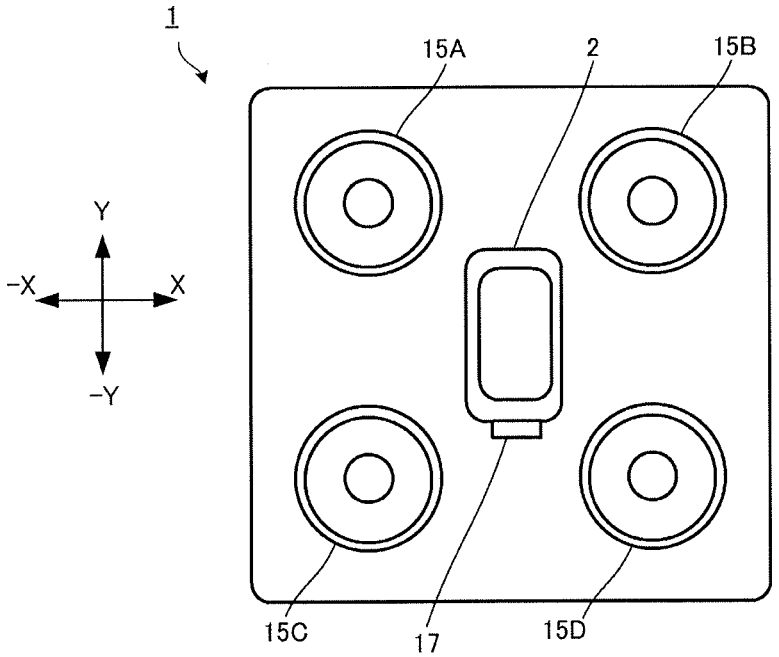
FIG. 1B is a view of the audio apparatus and the external device as viewed from the front side.
Figure 2A:
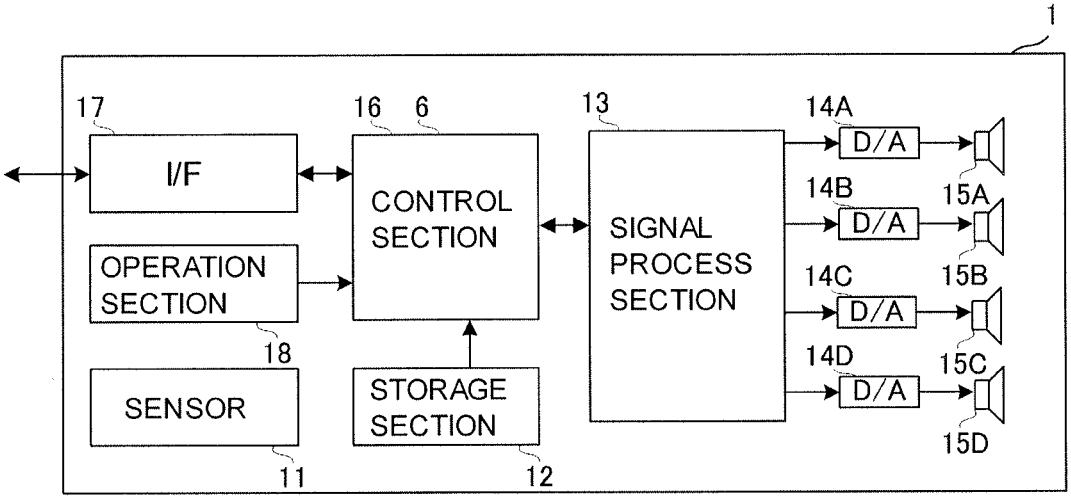
FIG. 2A is a block diagram showing the configuration of the audio apparatus.
Figure 2B:
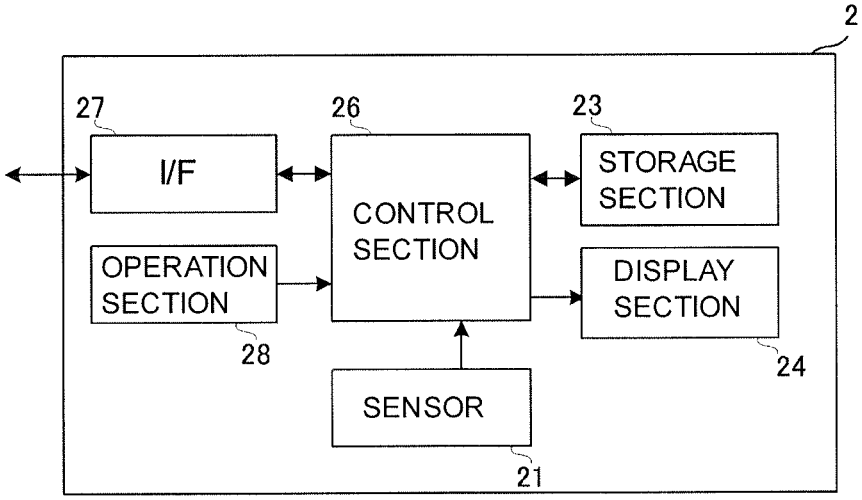
FIG. 2B is a block diagram showing the configuration of the external device.

FIG. 1A is an external perspective view of the audio apparatus and the external device, and FIG. 1B is a view of the audio apparatus and the external device as viewed in the Z-direction. FIG. 2A is a block diagram showing the configuration of the audio apparatus, and FIG. 2B is a block diagram showing the configuration of the external device. In the embodiment, the front surface direction of the audio apparatus is set as the Z-direction, the back surface direction of the audio apparatus is set as the −Z-direction, the right surface direction of the audio apparatus is set as the X-direction, the left surface direction of the audio apparatus is set as the −X-direction, the upper surface direction of the audio apparatus is set as the Y-direction, and the lower surface direction of the audio apparatus is set as the −Y-direction.

The audio apparatus 1 includes a rectangular parallelepiped housing (main body) 10. Although not shown in FIG. 1, an operation section 18 for adjusting the volume and the like, and connectors to which a power supply cable and the like are connected are provided on the housing 10. The housing 10 can be disposed on a desk or the like while one of the back, upper, lower, right, and left surfaces is directed to the vertically downward direction.

A plurality of speakers (a speaker 15A, a speaker 15B, a speaker 15C, and a speaker 15D) are disposed in the front surface of the housing 10. The sound emission directions of the speakers are directed in the front surface direction of the housing 10.

An interface (I/F) 17 which is used for attaching the external device 2 is disposed in the front surface of the housing 10. The interface 17 is configured by a connector which is projected in the Z-direction and also in the Y-direction. According to the configuration, the external device 2 can be attached to the front surface of the housing 10 in the same posture (in which the front surfaces of the external device 2 and the housing 10 are directed in the same direction, and the upper surfaces of the external device 2 and the housing 10 are directed in the same direction) as that of the audio apparatus 1. For example, the external device 2 is a portable music player, or an information processing terminal such as a tablet type computer, a PDA (Personal Digital Assistant), or a mobile telephone.

In the external device 2, audio data are stored in an internal storage section 23. A control section 26 reads out audio data from the storage section 23, and outputs the data to the outside through an interface 27. The external device 2 includes a touch panel configured by a display section 24 and an operation section 28.

The touch panel configured by the display section 24 and the operation section 28 is disposed in the front surface of the external device 2, and, when the external device 2 is attached to the audio apparatus 1, directed in the same direction as the front surface of the audio apparatus 1. In the case where the external device 2 is attached to the audio apparatus 1, therefore, the user can operate the external device while viewing the touch panel.

A control section 16 of the audio apparatus 1 receives audio data from the external device 2 through the interface 17 which functions as a receiving section. The control section 16 performs various operations by reading out various programs stored in a storage section 12, and developing the programs in an internal RAM (not shown). When receiving audio data through the interface 17, the control section 16 encodes the audio data and supplies the encoded data as a digital audio signal to a signal process section 13. The signal process section 13 incorporates a DSP, and applies various signal processes on the input digital audio signal. When stereo channel audio signals are input, for example, the signal process section 13 distributes respective channel audio signals to the speakers 15A, 15B, 15C, 15D under the control of the control section 16. The audio signals output from the signal process section 13 are converted by D/A converters 14A, 14B, 14C, 14D to analog audio signals, and then supplied to the speakers 15A, 15B, 15C, 15D. In this way, audio data of the external device 2 are reproduced, and then emitted as sounds from the audio apparatus 1.

The audio apparatus 1 includes a sensor 11 configured by a three-axis acceleration sensor, a digital compass, or a gyro sensor, and the like. The control section 16 detects the posture of the apparatus in accordance with a result of detection by the sensor 11.

The storage section 12 stores a conversion table in which the posture of the apparatus is corresponded to control contents of audio signals to be supplied to the speakers (see FIG. 9). The control section 16 detects the posture of the apparatus in accordance with a result of detection by the sensor 11, refers to the conversion table with the detected posture of the apparatus, and controls the audio signals to be supplied to the speakers.

Figure 3A:
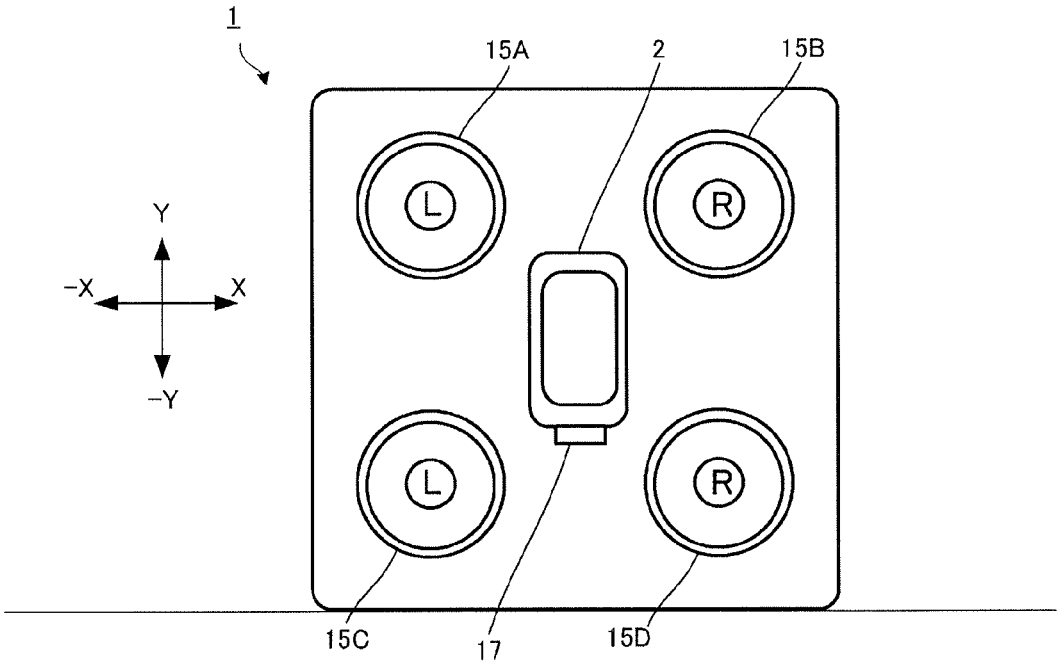
FIGS. 3A and 3B are views showing examples of controlling channels of audio signals to be supplied to speakers.
Figure 3B:
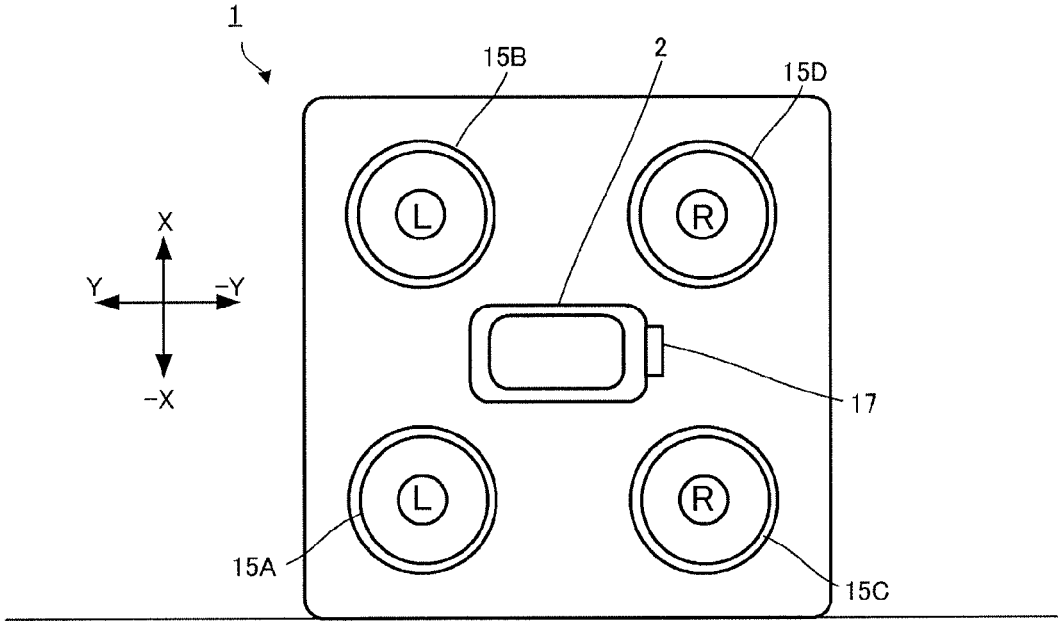

When the control section 16 detects that the lower surface of the housing 10 is directed to the vertically downward direction as shown in FIG. 3A, for example, the control section refers to the column of "Lower surface is downward directed" in the conversion table shown in FIG. 9, and supplies the right (R) channel audio signal to the speakers 15B, 15D which are located on the right surface side, and the left (L) channel audio signal to the speakers 15A, 15C which are located on the left surface side. Namely, the R-channel audio signal is supplied to the speakers 15B, 15D which are located relatively on the right side as viewed from the listener, and which emit a sound from the right side, and the L-channel audio signal is supplied to the speakers 15A, 15C which are located relatively on the left side as viewed from the listener. By contrast, when the control section 16 detects that the left surface of the housing 10 is directed to the vertically downward direction as shown in FIG. 3B, the control section refers to the column of "Left surface is downward directed" in the conversion table shown in FIG. 9, and supplies the R-channel audio signal to the speakers 15C, 15D which are located on the lower surface side, and the L-channel audio signal to the speakers 15A, 15B which are located on the upper surface side. Namely, the R-channel audio signal is supplied to the speakers 15*c*, 15D which are located relatively on the right side as viewed from the listener, and the L-channel audio signal is supplied to the speakers 15A, 15B which are located relatively on the left side as viewed from the listener.

Figure 4A:
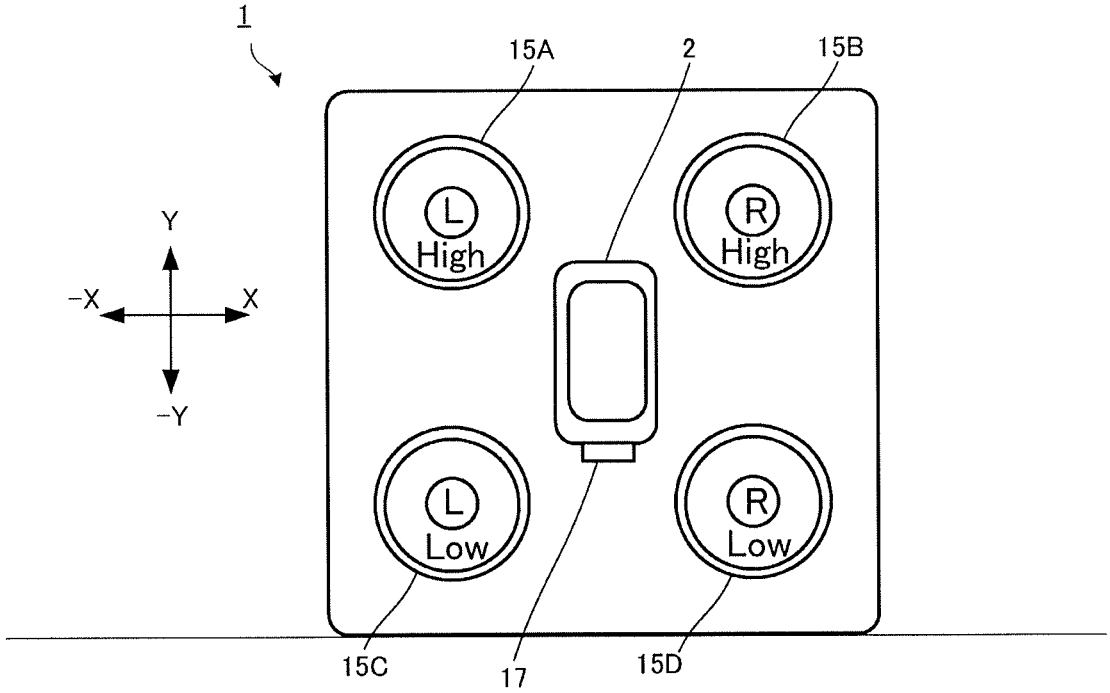
FIGS. 4A and 4B are views showing examples of controlling channels and bands of audio signals to be supplied to speakers.

When the audio apparatus of the embodiment is disposed while the lower, upper, right, or left surface is directed to the vertically downward direction, there exist a speaker which is located on the upper side as viewed from the listener, and that which is located on the lower side. When the control section 16 detects that the lower surface of the housing 10 is directed to the vertically downward direction as shown in FIG. 4A, the control section refers to the column of "Lower surface is downward directed" in the conversion table shown in FIG. 9, and supplies the high-frequency R-channel audio signal to the speaker 15B which is located on the right surface side and the upper surface side, the low-frequency R-channel audio signal to the speaker 15D which is located on the right surface side and the lower surface side, the high-frequency L-channel audio signal to the speaker 15A which is located on the left surface side and the upper surface side, and the low-frequency L-channel audio signal to the speaker 15C which is located on the left surface side and the lower surface side. Namely, the high-frequency R-channel audio signal is supplied to the speaker 15B which is located relatively on the upper right side as viewed from the listener, and which emits a sound from the upper right side, the low-frequency R-channel audio signal is supplied to the speaker 15D which is located relatively on the lower right side as viewed from the listener, and which emits a sound from the lower right side, the high-frequency L-channel audio signal is supplied to the speaker 15A which is located relatively on the upper left side as viewed from the listener, and which emits a sound from the upper left side, and the low-frequency L-channel audio signal is supplied to the speaker 15C which is located relatively on the lower left side as viewed from the listener, and which emits a sound from the lower left side.

Figure 4B:
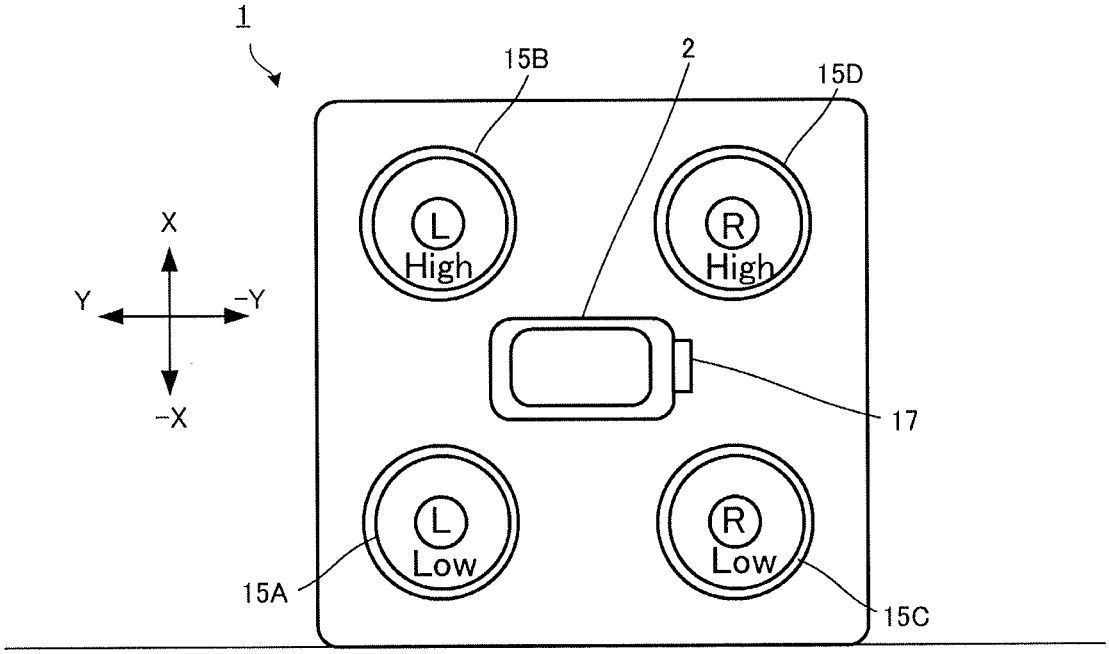

By contrast, when the control section 16 detects that the left surface of the housing 10 is directed to the vertically downward direction as shown in FIG. 4B, the control section refers to the column of "Left surface is downward directed" in the conversion table shown in FIG. 9, and supplies the high-frequency R-channel audio signal to the speaker 15D which is located on the right surface side and the lower surface side, the low-frequency R-channel audio signal to the speaker 15C which is located on the left surface side and the lower surface side, the high-frequency L-channel audio signal to the speaker 15B which is located on the right surface side and the upper surface side, and the low-frequency L-channel audio signal to the speaker 15A which is located on the left surface side and the upper surface side. Namely, the high-frequency R-channel audio signal is supplied to the speaker 15D which is located relatively on the upper right side as viewed from the listener, and which emits a sound from the upper right side, the low-frequency R-channel audio signal is supplied to the speaker 15C which is located relatively on the lower right side as viewed from the listener, and which emits a sound from the lower right side, the high-frequency L-channel audio signal is supplied to the speaker 15B which is located relatively on the upper left side as viewed from the listener, and which emits a sound from the upper left side, and the low-frequency L-channel audio signal is supplied to the speaker 15A which is located relatively on the lower left side as viewed from the listener, and which emits a sound from the lower left side. In the embodiment, the example in which channels and bands are controlled has been described. Alternatively, also a configuration may be possible where audio signals of the same channel (monaural audio signals) are supplied to all speakers, and only bands are controlled.

Figure 5A:
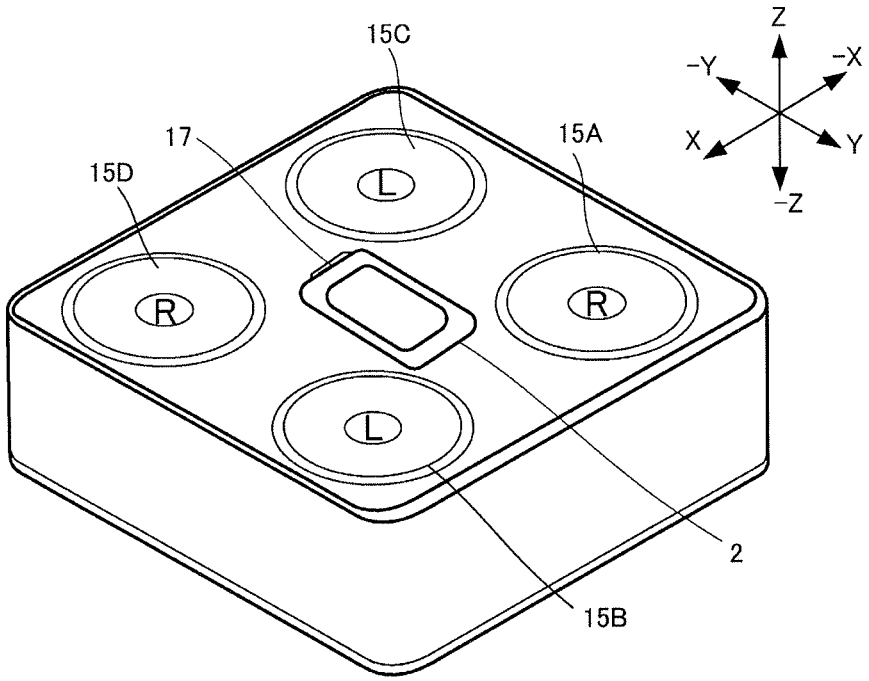
FIGS. 5A and 5B are views showing control examples in the case where the back surface of the audio apparatus is directed to the vertically downward direction.

When the control section 16 detects that the back surface of the housing 10 is directed to the vertically downward direction as shown in FIG. 5A, the control section refers to the column of "Back surface is downward directed" in the conversion table shown in FIG. 9, and supplies the R- and L-channel audio signals to the respective speaker sets in each of which speakers are located on a diagonal line. Namely, the R-channel audio signal is supplied to the speakers 15A, 15D, and the L-channel audio signal is supplied to the speakers 15B, 15C. Alternatively, the R-channel audio signal is supplied to the speakers 15B, 15C, and the L-channel audio signal is supplied to the speakers 15A, 15D.

Figure 5B:
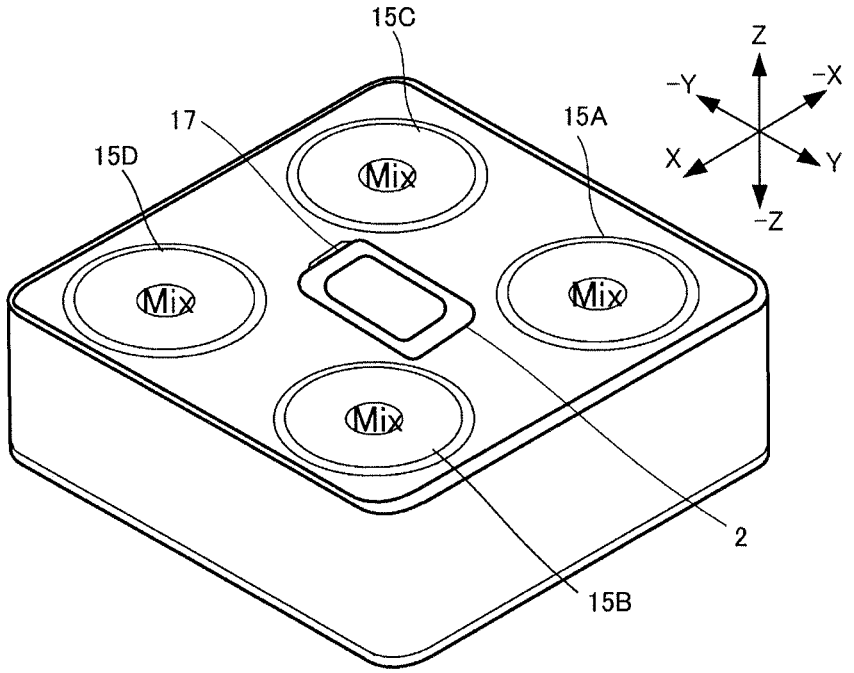

Alternatively, a configuration may be possible where, as shown in FIG. 5B, the control section 16 supplies audio signals of the same channel (mixed down monaural audio signal) to all speakers.

As other examples of controlling audio signals, control of the frequency characteristics, addition of acoustic effects (sound field), and the like may be contemplated. In the case where audio signals of the same channel (monaural audio signals) are supplied to all speakers as shown in FIG. 5B, particularly, the lateral stereoscopic feeling disappears, and therefore it is preferable to give a sound effect which produces sound spread feeling.

In the audio apparatus 1 of the embodiment, as described above, channels, bands, and the like are controlled in accordance with the installation posture, and hence an optimum sound emission mode is automatically realized even when the installation posture is changed.

Figure 6A:
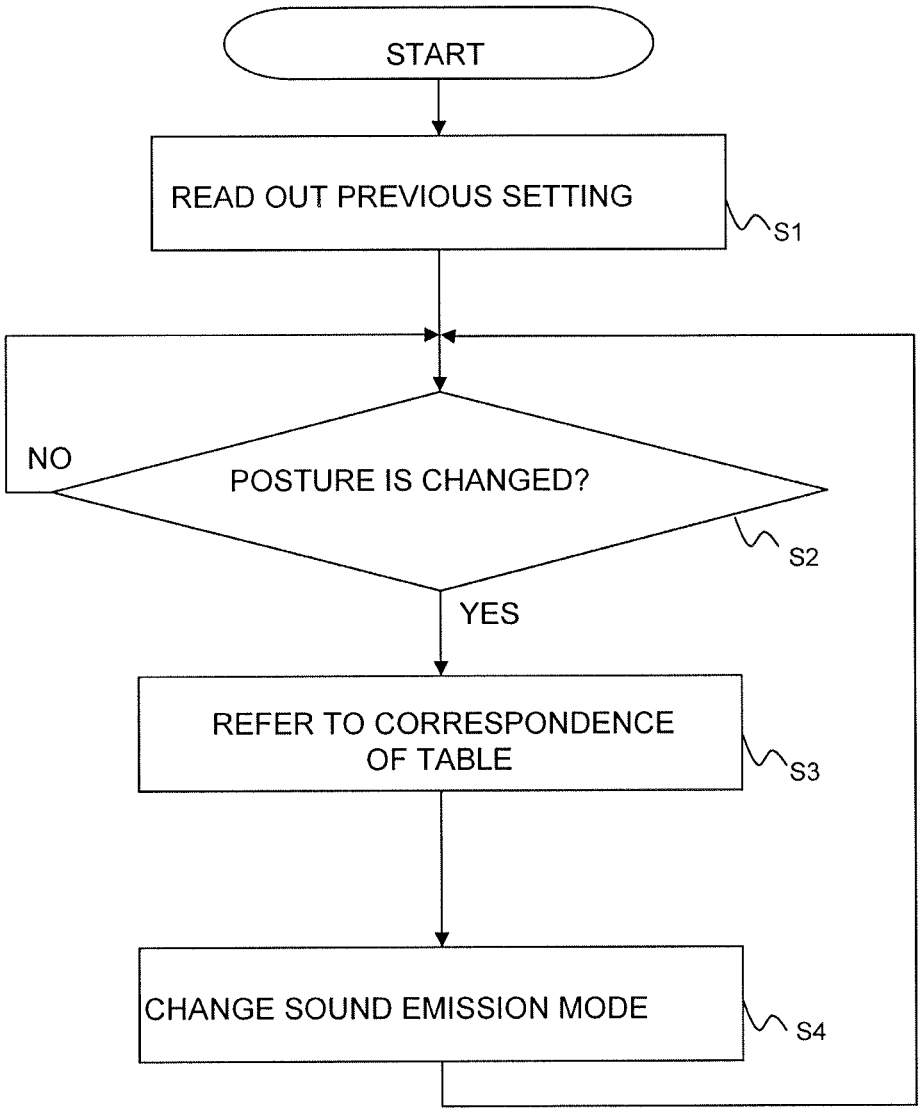
FIGS. 6A and 6B are flowcharts showing the operation of the audio apparatus.

Next, FIG. 6A is a flowchart showing the operation of the audio apparatus 1. After activation of the audio apparatus 1, the control section 16 first reads out initial setting stored in the storage section 12 (s1). The initial setting may be default control contents (for example, the control in which a monaural channel is supplied to all the speakers as in FIG. 5B) stored in the storage section 12. Alternatively, the installation posture of the audio apparatus 1 at the current time may be detected from a result of detection at the current time by the sensor 11, and control contents may be determined with reference to the conversion table stored in the storage section 12 with the detected posture.

Based on the result of detection by the sensor 11, the control section 16 determines whether the posture of the apparatus is changed or not (s2). If it is determined that the posture of the audio apparatus 1 is changed, the control section 16 refers to the conversion table stored in the storage section 12 (s3), reads out the control contents, and controls the audio signals to be supplied to the speakers (s4).

Figure 6B:
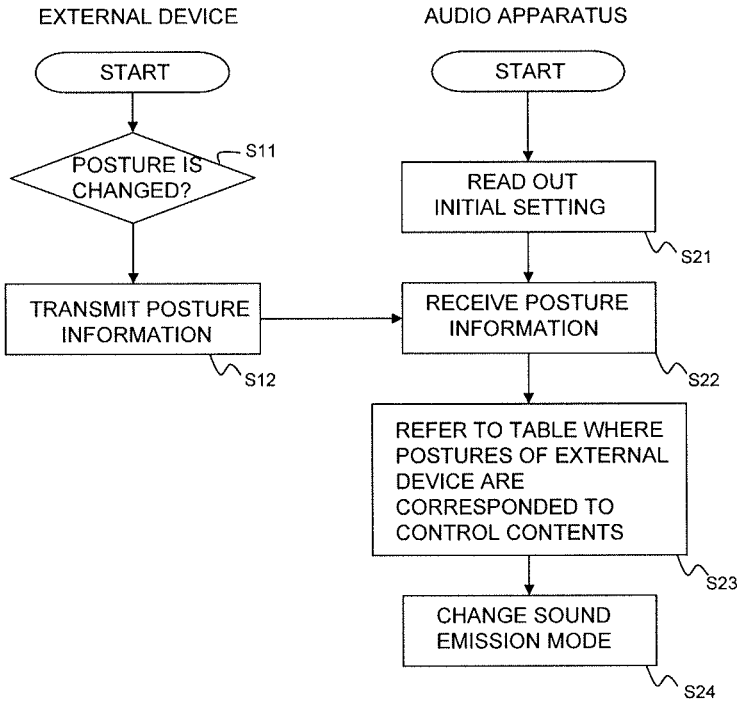

Alternatively, a configuration may be possible where, as shown in FIG. 6B, the control section 16 receives the posture information (sensor information) from the external device 2, and controls the audio signals to be supplied to the speakers based on the received posture information. In this case, the storage section 12 stores a conversion table in which the posture information of the external device is made correspondent to the control contents, and the control section 16 determines the posture of the apparatus based on the received posture information of the external device, and controls the audio signals to be supplied to the speakers with reference to the conversion table.

In this case, after activation, the control section 16 first reads out initial setting stored in the storage section 12 (s21). In this case, it is not required to detect the posture of the audio apparatus 1. Therefore, the initial setting coincides with the default control contents stored in the storage section 12.

Based on the result of detection by the sensor 21, the control section 26 of the external device 2 determines whether the posture of the audio device 1 is changed or not (s11). If it is determined that the posture of the audio device 1 is changed, the control section 26 transmits posture information to the audio apparatus 1. The posture information may be the result of detection by the sensor 21, or may be information indicating which one of the surfaces is directed to the vertically downward direction.

When the control section 16 of the audio apparatus 1 receives the posture information from the external device 2 (s22), the control section refers the conversion table in which the posture information of the external device 2 is made correspondent to the control contents (s23). Then, the control section 16 reads out the control contents, and controls the audio signals to be supplied to the speakers (s24).

In the example of FIG. 6B, the conversion table of control contents is defined assuming that, as a result of attachment of the external device 2 to the audio apparatus 1, the audio apparatus 1 and the external device 2 have the same posture. In the case where the interface 17 is disposed at a different position or in a different direction, they do not always have the same posture. In the case where the connector is projected in the Z-direction, for example, the external device 2 is installed vertical to the front surface of the audio apparatus 1. In the case where the back surface of the audio apparatus 1 is directed to the vertically downward direction, therefore, the lower surface of the external device 2 is directed to the vertically downward direction. In this case, the storage section 12 stores a conversion table in which, as shown in FIG. 10, information indicating that the lower surface of the external device 2 is directed to the vertically downward direction is made correspondent to control contents of the case where the back surface of the audio apparatus 1 is directed to the vertically downward direction. When the control section 16 receives information indicating that the lower surface is directed to the vertically downward direction, as the posture information from the external device 2, the control section refers to "Posture information: Lower surface is downward directed" in FIG. 10, and realizes the control (the example in FIG. 5) in the case where the back surface of the audio apparatus 1 is directed to the vertically downward direction.

In an application example of the invention, a configuration may be possible where supply destination information indicative of the supply destinations of the audio signals of the external device 2 is received, and the control section 16 determines the speakers of the supply destinations of the received audio signals, based on the received supply destination information.

Figure 7:
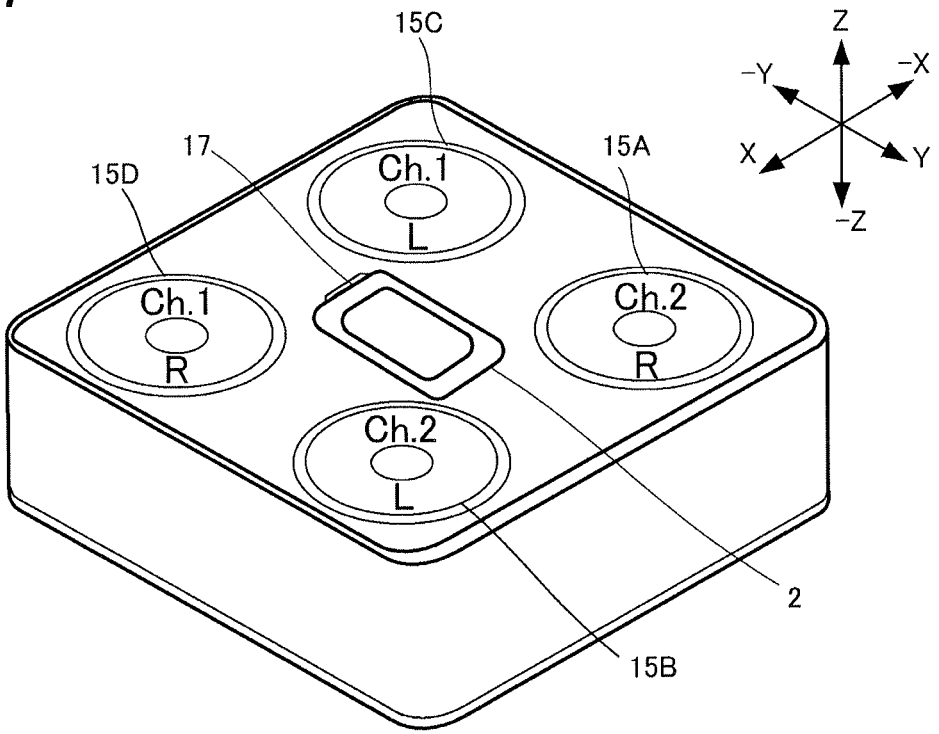
FIG. 7 is a view showing a control example of an application example.

FIG. 7 is a view showing a control example of the application example. In this case, the audio apparatus 1 realizes a sound emission mode which is in solidarity with the external device 2. Hereinafter, the case where, as shown in FIG. 7, the external device 2 is attached to the middle of the front surface of the audio apparatus 1, and two speakers are disposed in each of the upper and lower surfaces of the external device 2 (four speakers in total) will be described.

In this case, it is assumed that the external device 2 is a gaming machine (or an information processing terminal incorporating a game function), and a single gaming machine attached to the audio apparatus 1 is operated simultaneously by a plurality of users. Namely, the case is assumed where one user exists in the lower surface side of the external device 2 (the side where the speaker 15C, 15D are disposed), the other user exists in the upper surface side of the external device 2 (the side where the speaker 15A, 15B are disposed), and the users simultaneously operate the touch panel of the external device 2.

In this case, the external device 2 transmits supply destination information indicating that the supply destination of the sound (Ch. 1) for the one user is the speakers of the lower surface side, and that of the sound (Ch. 2) for the other user is the speakers of the upper surface side.

In the case where the external device 2 is a gaming machine, the basic program of the external device 2 causes supply destination information such as described above to be transmitted to the control section 16, or application software causes supply destination information such as described above to be transmitted to the control section 16. Also in the case where the external device 2 is an information processing terminal incorporating a game function, application software causes supply destination information such as described above to be transmitted to the control section 16.

When receiving the supply destination information, the control section 16 of the audio apparatus 1 supplies the audio signal of Ch. 1 which is input from the external device 2, to the speakers 15C, 15D. At this time, the R-channel audio signal is supplied to the speaker 15D which is located on the right side as viewed from the user, and the L-channel audio signal is supplied to the speaker 15C which is located on the left side as viewed from the user. Similarly, when receiving the supply destination information, the control section 16 supplies the R-channel audio signal of the audio signal of Ch. 2 which is input from the external device 2, to the speaker 15A, and the L-channel audio signal to the speaker 15B.

Figure 8A:
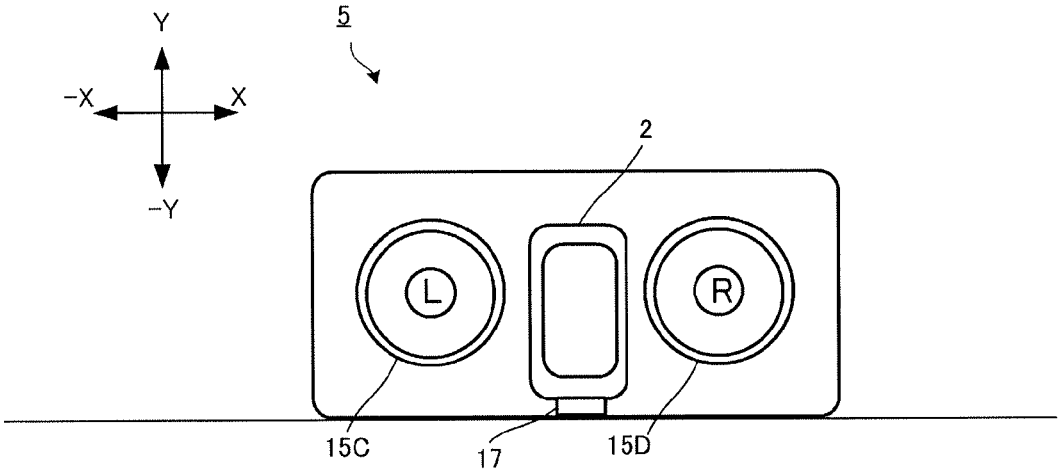
FIGS. 8A and 8B are views showing an audio apparatus according to a modification.

Although, in the embodiment, the example in which the four speakers are disposed has been described, the number and disposed positions of the speakers are not limited to this example. For example, the same control is enabled also in the case of an audio apparatus 5 in which, as shown in FIG. 8A, two speakers 15C, 15D are disposed. In the audio apparatus 5, the speakers 15A, 15B are omitted from the audio apparatus 1 shown FIGS. 1 and 2, and the other configuration is identical therewith.

Figure 8B:
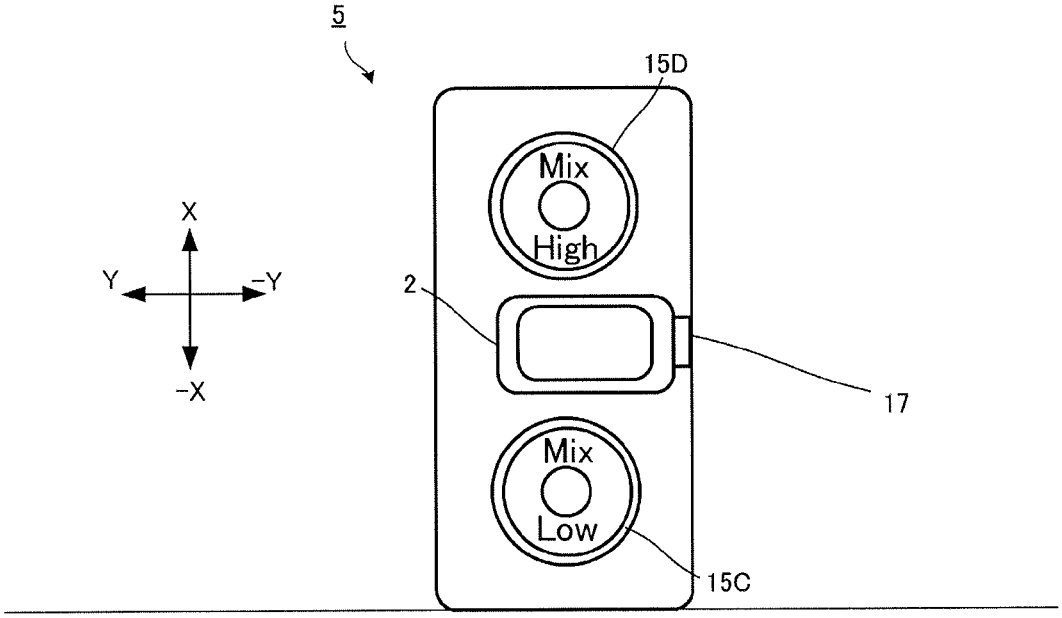

In this case, when the control section 16 detects that the lower surface of the housing 10 is directed to the vertically downward direction, the control section supplies the R-channel audio signal to the speaker 15D which is located on the right surface side, and the L-channel audio signal to the speaker 15C which is located on the left surface side. By contrast, when the control section 16 detects that the left surface of the housing 10 is directed to the vertically downward direction as shown in FIG. 8B, the control section supplies the low-frequency component of the mixed down monaural audio signal to the speaker 15C which is located on the left surface side, and the high-frequency component of the monaural audio signal to the speaker 15D which is located on the right surface side. In the installation posture of FIG. 8A, namely, the R-channel audio signal is supplied to the speaker 15D which is disposed relatively on the right side as viewed from the listener, and the L-channel audio signal is supplied to the speaker 15C which is disposed relatively on the left side as viewed from the listener. In the installation posture of FIG. 8B, by contrast, the high-frequency audio signal is supplied to the speaker 15C which is located relatively on the upper side as viewed from the listener, and the low-frequency audio signal is supplied to the speaker 15C which is located relatively on the lower side as viewed from the listener.

In the case where monaural audio signals are supplied as in FIG. 8B, the lateral stereoscopic feeling disappears, and therefore it is preferable to give a sound effect which produces sound spread feeling. Also even in the case where the channel control is not performed in the installation posture of FIG. 8B, the L-channel audio signal is supplied to the speaker 15C, and the R-channel audio signal is supplied to the speaker 15D, the lateral stereoscopic feeling disappears, and therefore it is preferable to give a sound effect which produces sound spread feeling.

Here, the details of the above embodiments are summarized as follows.

The audio apparatus of the present disclosure includes a plurality of speakers disposed in a main body, a storage section which stores a conversion table showing a correspondence between postures of the main body and control contents of audio signals to be supplied to the speakers, and a control section which refers to the conversion table stored in the storage section in accordance with the posture of the apparatus, and which controls the audio signals to be supplied to the speakers.

In the case where an audio apparatus has two speakers disposed on the right and left front sides of the main body, and the speakers are installed so as to emit a sound in the front direction, when the audio apparatus is installed in a posture in which the lower surface of the main body is directed to the vertically downward direction, for example, the speakers are disposed in a similar manner as usual stereo speakers which are disposed on the right and left sides with respect to the listener. When detecting that the apparatus is installed while the lower surface is directed to the vertically downward direction, therefore, the control section supplies a left-channel audio signal to the speaker which is located on the right side as viewed toward the listener, and a right-channel audio signal to the speaker which is located on the left side as viewed toward the listener. By contrast, when the audio apparatus is installed in a posture in which the right or left surface is directed to the vertically downward direction, the speakers are disposed in a similar manner as two-way speakers which are disposed on the upper and lower sides with respect to the listener, respectively. When detecting that the apparatus is installed while the right surface is directed to the vertically downward direction, therefore, the control section supplies a low-frequency audio signal to the speaker which is located on the right surface side, and a high-frequency audio signal to the speaker which is located on the left surface side. Conversely, when detecting that the apparatus is installed while the left surface is directed to the vertically downward direction, the control section supplies a low-frequency audio signal to the speaker which is located on the left surface side, and a high-frequency audio signal to the speaker which is located on the right surface side.

By the above configuration, the conversion table of the storage section is defined in accordance with the detected posture of the apparatus, and hence an optimum sound emission mode is automatically realized even when the installation posture is changed.

For example, the audio apparatus further includes a receiving section which receives posture information from an external device, and the control section may be configured so as to detect the posture of the apparatus based on the posture information received by the receiving section.

Assuming that the external device and the audio apparatus have the same posture, when receiving posture information indicating that the lower surface is directed to the vertically downward direction, a posture detecting section determines that the apparatus is installed while directing the lower surface of the apparatus to the vertically downward direction. Therefore, the control section supplies a left-channel audio signal to the speaker which is located on the right side as viewed toward the listener, and a right-channel audio signal to the speaker which is located on the left side as viewed toward the listener. By contrast, when the audio apparatus is installed in a posture in which the right or left surface is directed to the vertically downward direction, the speakers are disposed in a similar manner as two-way speakers which are disposed on the upper and lower sides of with respect to the listener, respectively. When receiving posture information indicating that the right surface is directed to the vertically downward direction, therefore, the control section supplies a low-frequency audio signal to the speaker which is located on the right surface side, and a high-frequency audio signal to the speaker which is located on the left surface side. Conversely, when receiving posture information indicating that the left surface is directed to the vertically downward direction, the control section supplies a low-frequency audio signal to the speaker which is located on the left surface side, and a high-frequency audio signal to the speaker which is located on the right surface side.

By the above configuration, channels, bands, and the like are controlled in accordance with the posture of the attached external device, and hence an optimum sound emission mode is automatically realized even when the installation posture is changed.

Supposing that the external device and the audio apparatus have different postures, the conversion table may have contents showing correspondences between posture information received from the external device and control contents of the audio signals to be supplied to the speakers. In the case where, when the back surface of the audio apparatus is directed to the vertically downward direction, the lower surface of the external device is directed to the vertically downward direction, for example, the storage section stores a conversion table in which information indicating that the lower surface is directed to the vertically downward direction is made correspondent to control contents in the case where the back surface of the audio apparatus is directed to the vertically downward direction.

For example, the receiving section receives supply destination information indicative of supply destinations of audio signals, from the external device, and the control section determines speakers of the supply destinations of the received audio signals, based on the supply destination information received by the receiving section.

In this case, it is possible to realize a sound emission mode which is in solidarity with the external device. For example, the case will be considered where two speakers are disposed in the right and lefts sides of the upper surface of the audio apparatus, and the external device is attached so as to be interposed between the speakers. In the case where the external device is a gaming machine (or a device incorporating a game function) and a single gaming machine attached to the audio apparatus is operated simultaneously by a plurality of users, a sound for one user is output from one of the speakers, and that for the other user is output from the other speaker.

Although the invention has been illustrated and described for the particular preferred embodiments, it is apparent to a person skilled in the art that various changes and modifications can be made on the basis of the teachings of the invention. It is apparent that such changes and modifications are within the spirit, scope, and intention of the invention as defined by the appended claims.

The present application is based on Japanese Patent Application No. 2011-274250 filed on Dec. 15, 2011, the contents of which are incorporated herein by reference.

What is claimed is:

1. An audio apparatus comprising:

a main body;

a plurality of speakers provided in the main body;

a receiving section on the main body configured to receive an external device and receive posture information of the external device from the external device, the external device providing audio signals to said plurality of speakers and including a posture detector configured to generate the posture information;

a storage section configured to store a conversion table which indicates a correspondence between postures of the external device and control contents of audio signals to be supplied to the speakers; and a control section configured to refer to the conversion table of the storage section, and control the audio signals to be supplied to the speakers in accordance with the posture information of the external device received by the receiving section.

2. The audio apparatus according to claim 1, further comprising:

a supply destination information receiving section that receives supply destination information indicative of supply destinations of the audio signals, from the external device, wherein the control section configured to determine the speakers of the supply destinations of the audio signals, based on the supply destination information received by the supply destination information receiving section.

3. The audio apparatus according to claim 1, wherein the control section configured to control channels of the audio signals to be supplied to the speakers.

4. The audio apparatus according to claim 1, wherein the control section configured to control bands of the audio signals to be supplied to the speakers.

5. The audio apparatus according to claim 1, further comprising:

a content receiving section which receives content data from the external device, wherein the control section configured to supply the audio signals to the speakers to reproduce the content data.

6. The audio apparatus according to claim 1, further comprising:

a connector provided on the housing, wherein the connector is configured that the external device is attached thereto in the same posture as that of the main body.

7. A method of changing a sound emission mode of an audio apparatus, comprising:

receiving at a receiving section on the main body of the audio apparatus, the receiving section being configured to receive an external device, audio signals and posture information of the external device from the external device, the external device including a posture detector configured to generate the posture information;

referring to a conversion table stored in a storage section, wherein the conversion table indicates a correspondence between postures of the external device and control contents of audio signals to be supplied to speakers provided in the main body; and controlling the audio signals to be supplied to the speakers in accordance with the posture information of the external device received from the external device and the correspondence of the conversion table.

8. The method according to claim 7, further comprising:

receiving supply destination information indicative of supply destinations of the audio signals, from the external device, determining the speakers of the supply destinations of the audio signals, based on the supply destination information received from the external device.

9. The method according to claim 7, wherein in the controlling process, channels of the audio signals to be supplied to the speakers are controlled.

10. The method according to claim 7, wherein in the controlling process, bands of the audio signals to be supplied to the speakers are controlled.

11. The method according to claim 7, further comprising:

receiving content data from the external device; and supplying the audio signals to the speakers to reproduce the content data.

* * * * *